US008549667B1

(12) United States Patent
Fuller

(10) Patent No.: US 8,549,667 B1
(45) Date of Patent: Oct. 8, 2013

(54) ARTICLES OF CLOTHING WITH A BOTTLE OPENER

(76) Inventor: Anthony Fuller, Sacramento, CA (US)

( * ) Notice: Subject to any disclaimer, the term of this patent is extended or adjusted under 35 U.S.C. 154(b) by 94 days.

(21) Appl. No.: 12/945,782

(22) Filed: Nov. 12, 2010

Related U.S. Application Data

(60) Provisional application No. 61/260,572, filed on Nov. 12, 2009.

(51) Int. Cl.
*A41D 19/00* (2006.01)

(52) U.S. Cl.
USPC ..... 2/160; 81/3.55

(58) Field of Classification Search
USPC ..... 2/69, 247, 84; 81/3.4, 3.57, 3.55
See application file for complete search history.

(56) References Cited

U.S. PATENT DOCUMENTS

| | | | | | |
|---|---|---|---|---|---|
| 2,470,606 | A * | 5/1949 | Dennison | 81/3.55 |
| 3,500,477 | A * | 3/1970 | Meszaros | 2/161.8 |
| 4,805,238 | A * | 2/1989 | Crafts | 2/20 |
| 5,133,233 | A * | 7/1992 | Erwin | 81/3.57 |
| 5,261,299 | A * | 11/1993 | Kondos | 81/3.09 |
| 5,276,922 | A * | 1/1994 | Floyd, Jr. | 2/160 |
| D363,157 | S * | 10/1995 | Rodgers | D2/866 |
| 6,041,532 | A * | 3/2000 | Pollhaus et al. | 40/455 |
| 6,098,497 | A * | 8/2000 | Larose | 81/3.4 |
| 6,189,154 | B1 * | 2/2001 | Ducharme | 2/338 |
| 6,553,575 | B1 * | 4/2003 | Davenport et al. | 2/161.2 |
| 7,284,284 | B2 * | 10/2007 | Wysopal | 2/209.13 |
| 7,325,255 | B2 * | 2/2008 | Cunliffe | 2/209.13 |
| 7,469,428 | B2 * | 12/2008 | Brauner et al. | 2/171 |
| 7,484,249 | B1 * | 2/2009 | Reese et al. | 2/48 |
| 8,196,221 | B2 * | 6/2012 | Fuwausa et al. | 2/69 |
| 8,206,236 | B1 * | 6/2012 | Neu | 473/282 |
| 8,220,075 | B2 * | 7/2012 | Chen et al. | 2/132 |
| 2002/0069450 | A1 * | 6/2002 | McNamara | 2/244 |
| 2006/0031977 | A1 * | 2/2006 | Wysopal | 2/209.13 |
| 2006/0117462 | A1 * | 6/2006 | Wysopal | 2/209.13 |
| 2006/0150798 | A1 * | 7/2006 | Tafolla | 84/327 |
| 2007/0163028 | A1 * | 7/2007 | Brauner et al. | 2/175.7 |
| 2009/0049956 | A1 * | 2/2009 | Brennan | 81/3.57 |
| 2009/0199325 | A1 * | 8/2009 | Fuwausa et al. | 2/244 |
| 2011/0179545 | A1 * | 7/2011 | Rummel | 2/69 |
| 2011/0219515 | A1 * | 9/2011 | Chen et al. | 2/132 |

* cited by examiner

*Primary Examiner* — Richale Quinn
(74) *Attorney, Agent, or Firm* — John P. O'Banion

(57) ABSTRACT

A functional article of clothing is provided with a pocket preferably on the interior surface of the article of clothing with an access opening and a transverse slot; and a bottle opener disposed within the pocket. The mouth of the opener is oriented with the transverse slot of the pocket so that the mouth of the opener is open to the outside of the pocket when the bottle opener is disposed within said pocket and the opener can engage a bottle without being removed from the pocket. In one embodiment the pocket is formed with a rectangular sheet with a slot that is folded lengthwise over a lower hem and the sides are secured to the clothing by stitching or fasteners. The opener and the pocket may include advertising indicia.

16 Claims, 8 Drawing Sheets

ARTICLES OF CLOTHING WITH A BOTTLE OPENER

CROSS-REFERENCE TO RELATED APPLICATIONS

This application claims priority from U.S. provisional application Ser. No. 61/260,572 filed on Nov. 12, 2009, and is incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention pertains generally to functional clothing and more particularly to clothing or other articles with a pocket retaining a container opener, as well as a pocket forming application that can be fastened along any edge of a garment or bag or other item with a generally linear edge. The container can be opened with the opener remaining in the pocket. The pocket and the container opener preferably include advertising or other promotional indicia.

2. Description of Related Art

One common feature of bottles of liquid such as beer, soda or juice is a lid covering the opening of the bottle that requires removal for access to the liquid. Such metal lids or caps are sealed on to the bottle opening at the bottling facility by being placed and crimped by machines. Liquids that are carbonated create a pressure in the interior of the bottle with an increase in the temperature of the bottle and liquid within the bottle, so the lid must be firmly placed on the bottle top to maintain the seal. Removal of the lid from the bottle cannot be done by hand and requires a bottle opener to provide a mechanical means for prying the crimped metal lid from the bottle opening.

Conventional bottle openers have a ring or loop with handle to provide some mechanical advantage with a lever and fulcrum. The length of the handle increases the mechanical advantage of the opener. The bottom of the bottle is normally placed on a flat surface and the bottle opener engages the rim of the cap that is typically forced upwardly and off of the bottle with the pivoting of the opener. However, the bottle opener must be located from its place of storage for use when the opening of a bottle is desired. This search can be time consuming and may detract from other activities. Furthermore, the long handle and overall size of the conventional bottle opener makes it difficult and inconvenient to carry in a trouser or shirt pocket. The size and length of handle and opener head interfere with the normal movements of the leg at the hip. The size and weight of conventional openers also make them inconvenient to transport in the breast pocket of a shirt because the opener weighs down the shirt and falls out easily when the user is bending over. Because of the inconvenience and impracticality of the conventional bottle opener, most people do not carry an opener with them. Consequently, an opener must be located every time a bottle needs to be opened.

The inconvenience of locating and transporting an opener is one of the main reasons that some bottlers adopted "twist top" opening systems. In the twist top setting the crimped cap can be rotated and removed. However, the force that is needed to twist the cap off of the bottle is significant and can be painful. In addition, people with limited grip strength must still use a bottle opener to remove the twist top bottle cap.

Accordingly, there is a need for a bottle opener that is small in size, easily transportable, readily available to the user, easy to use and will not get lost indoors or outdoors. The present invention satisfies this need, as well as others, and generally overcomes the deficiencies of the prior art.

BRIEF SUMMARY OF THE INVENTION

By way of example and not of limitation, the apparatus of the present invention generally comprises an article of clothing like a shirt with a pocket mounted to the interior of the bottom hem of the shirt. The bottle opener is disposed within the pocket that has an opening that permits the placement of the lid of the bottle in contact with the functional parts of the opener without removing it from the pocket. Clothing with a pocket and bottle opener combination according to the invention permits the wearer to open a beer or soda bottle with easy access to the bottle opener and without the need for searching for an opener because it is part of the clothing.

The pocket that has a side opening is preferably formed on an article of clothing, garment bag or other item that has a generally horizontal edge. The lower hemmed edge of a shirt, a skirt or coat liner are particularly suitable locations for placing the pocket. The pocket is formed with a rectangular body that has an opening near one end and preferably has advertising or other promotional information printed on the body opposite the end with the opening. The body is preferably folded over the horizontal edge of the article of clothing along the short axis of the body so that equal parts of the pocket body are on the interior and exterior surfaces of the item of clothing. The side opening of the body is preferably situated on the interior surface of the article of clothing. The side edges of the body preferably are sewn together through the clothing forming an interior pocket with the side opening open to the interior of the shirt of other article of clothing. In one embodiment, the body is removable and transferable from one shirt to another.

The bottle opener is preferably planar and capable of being placed in the sleeve with the functional opening of the bottle opener accessible through the side opening of the pocket. The opener is preferably made of metal or other strong material that will not break with the application of the force required to remove a crimped cap from a bottle.

The opener preferably has a circular shape, but can have any geometric shape desired. In one embodiment, the opener is square shaped so that it fits snugly in the pocket and does not rotate within the pocket. The generally flat back side of the opener has space for advertising or other promotional indicia. For example, the advertising may be the logo for a beverage manufacturer, sports team, school, social organization, fund raising effort or other group or organization. The openers themselves can be sold or distributed as promotional items from an organization to owners of clothing with the opener retaining pockets. The openers with different indicia can also be collected.

The pocket and opener are preferably positioned on a shirt on the front half section of the shirt on either the left quarter or right quarter. This preferred positioning keeps the opener available for use without removing it from the pocket or twisting the material of the shirt to the right position during use. The bottle be held with one hand and can be brought to the interior edge of the shirt and through the side opening of the pocket to the opener. The opener is held with the other hand and the cap removed. In this fashion, the length of the bottle can be used as a lever rather than the bottle opener.

The opener can also include a sound generator and actuator that emits an advertising jingle, music, noises, humorous statements or noises when used or a button is depressed.

It is therefore a general object of the present invention to provide an improved clothing and bottle opener combination that is economical to manufacture and easy to use.

Another object is to provide a clothing-bottle opener apparatus which is accessible to the wearer at any time for use and the opener can be permanent or removed for washing.

Another object of the invention is to provide a medium for advertising indicia and method for advertising that is permanently applied to clothing.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus and methods generally illustrated in FIG. 1 through FIG. 9. It will be appreciated that the apparatus may vary as to configuration and as to details of the parts, and that the methods and use may vary as to the specific steps and sequence, without departing from the basic concepts as disclosed herein.

Figure 1:
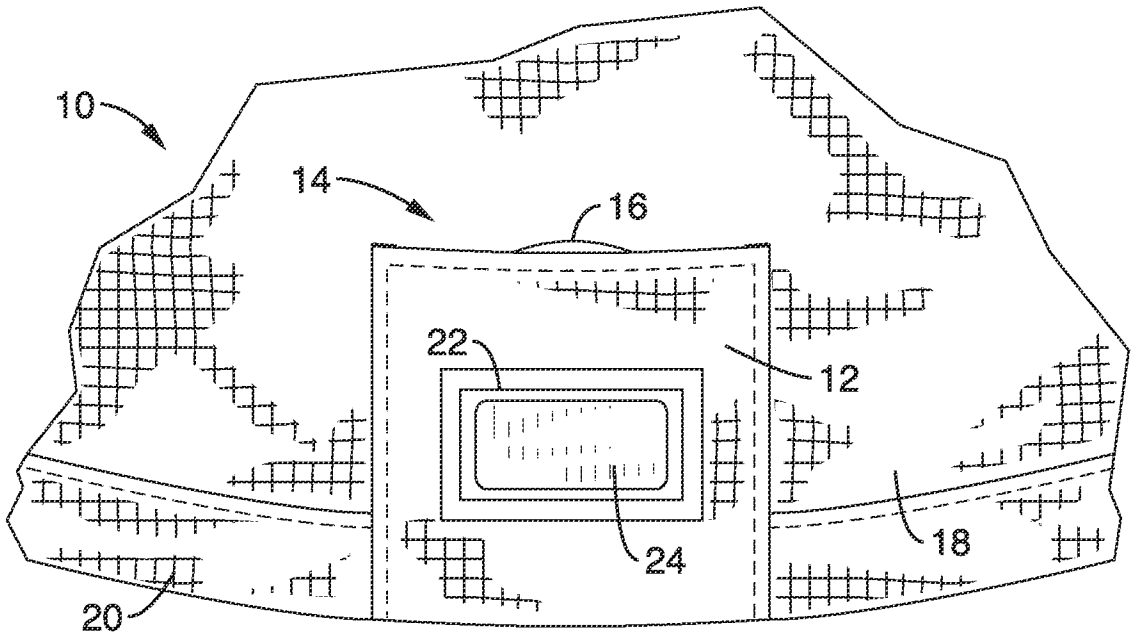
FIG. 1 is a front view of one embodiment of the invention mounted to the lower hem of an article of clothing with the front opening of the pocket facing the interior.

Turning now to FIG. 1, one embodiment of the combination shirt-bottle opener apparatus is generally shown to illustrate the invention. In this embodiment, the apparatus 10 has a pocket body 12 that includes an interior 14 that is preferably sized to receive a bottle opener 16. The pocket 12 is preferably positioned on the interior surface 18 of the shirt so that the bottom or closed end of the pocket is along the bottom hem 20 of the shirt. The pocket 10 is preferably open so that the bottle opener 16 can be inserted and removed from the interior of pocket body 12 through an access opening at the top of the pocket. For example, the opener can be removed prior to washing the shirt. However, in one embodiment, the top of the pocket is sewn shut after the opener is placed and properly oriented within the pocket body 12.

The pocket body 12 has a transverse opening 22 or slot in this embodiment that is sized and configured to receive a bottle top and cap and to give access to the mouth 24 of bottle opener 16. During use, the bottle cap is placed in the mouth 24 of bottle opener and the cap is pried off of the bottle.

In the embodiments shown in FIG. 1 through FIG. 4, the pocket is preferably placed on the front section of the shirt in either the left or right quarters with the pocket in the interior of the article of clothing and the opening 22 of the pocket facing outwardly from the interior surface 18 of the shirt. This placement is preferred so that the opener is accessible without pulling the shirt to properly orient the opener or removing the opener from the pocket to use. This placement also keeps the apparatus 10 from interfering with normal arm or body movements.

Although the pocket is placed on the lower horizontal edge 20 of a shirt in this illustration, it will be understood that the pocket can be placed on different articles of clothing such as a skirt, or interior liner of a coat or sweatshirt. The pocket 10 can also be placed on a sleeve edge or horizontal interior pocket edge or hood. The pocket can also be placed on suitable non-clothing items as well such as a garment bag or open purse.

Figure 2:
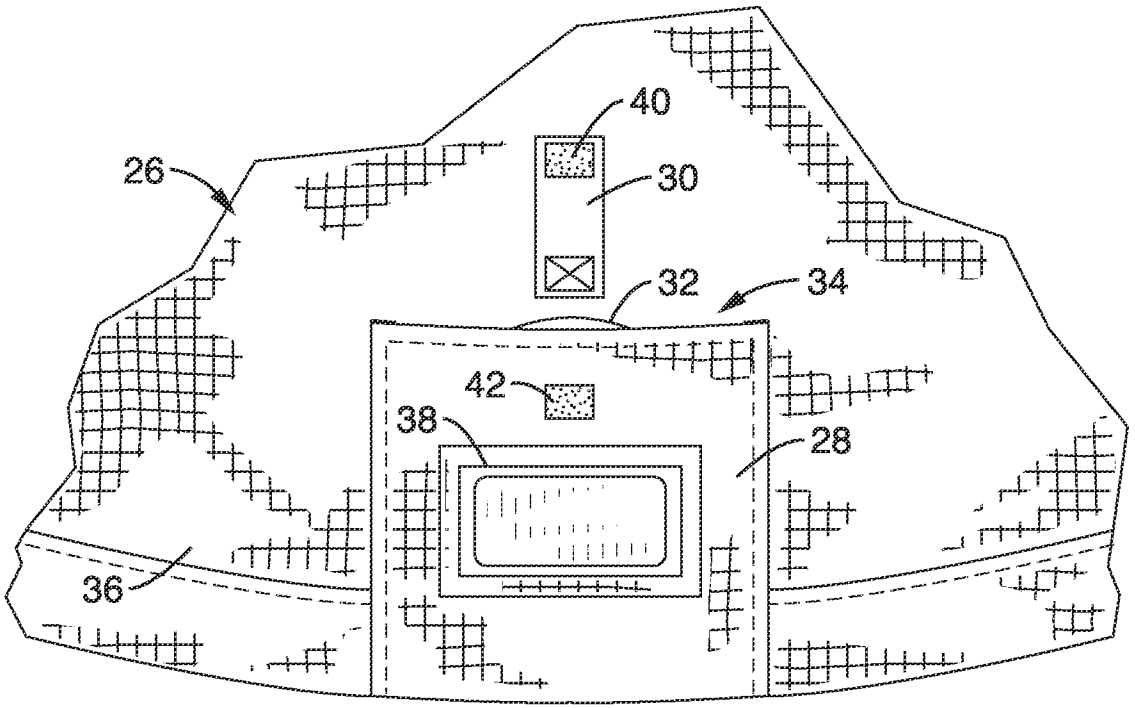
FIG. 2 is an alternative embodiment of the invention mounted to the lower hem of an article of clothing with an opener restraining strip and the front opening of the pocket facing the interior.

Turning next to FIG. 2, an alternative embodiment 26 of the pocket 28 is shown with one type of opener retaining flap 30 that is used to secure the bottle opener 32 that has been placed within the interior enclosure 34 of pocket 28 through the top access opening with the flap in the open position. In this embodiment, one edge of the flap 30 and both of the sides of the pocket 28 are sewn into the interior surface 36 of the shirt. The pocket 28 has a transverse opening 38 to allow access of a bottle cap to the mouth of the bottle opener 32 when placed in the interior 34 of pocket 28. The flap 30 has corresponding hook and loop fastener panels, one panel 40 mounted to the flap 30 and one panel 42 mounted to the exterior of the pocket 28. The flap panel 40 is joined to the pocket panel 42 when the flap 30 is folded over to retain the opener 32 within the pocket 28. The retaining flap 30 keeps the opener 32 secure in the pocket during the normal movements and activities of the wearer.

Figure 3:
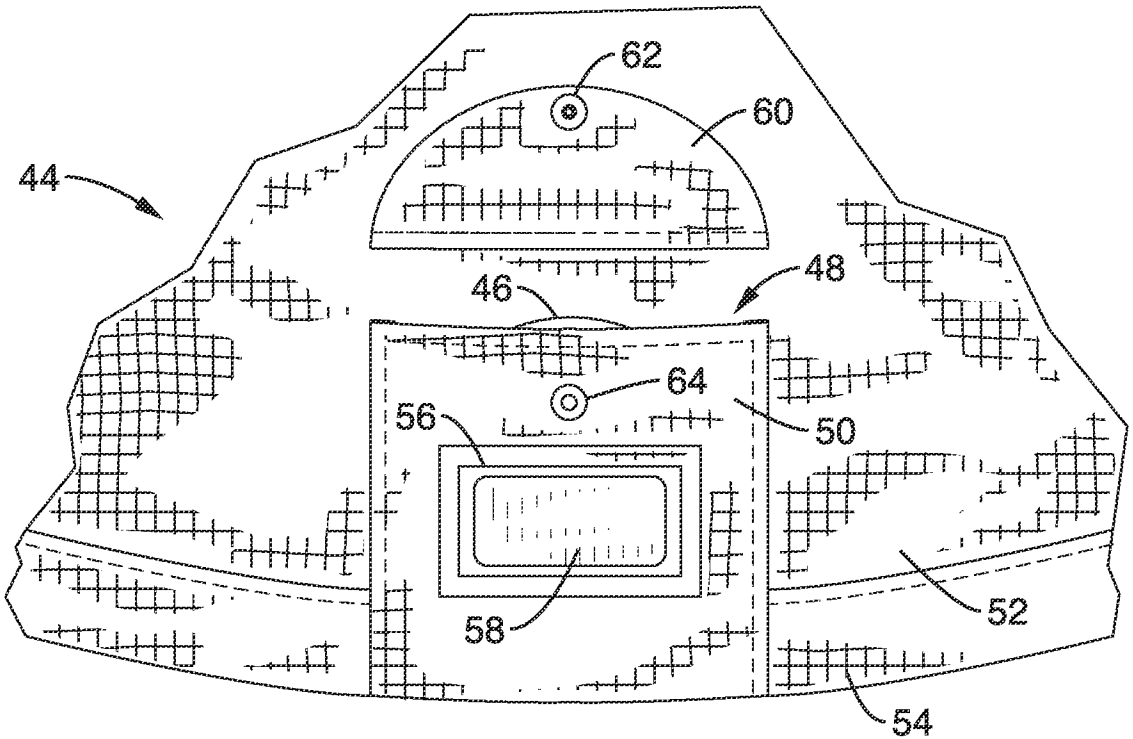
FIG. 3 is an alternative embodiment of the invention mounted to the lower hem of an article of clothing with a top opening flap and snap and the front opening of the pocket facing the interior.

Referring now to FIG. 3, a second alternative embodiment 44 of the invention is shown. The opener 46 has been placed through access opening 48 to the interior enclosure of the pocket 50 that has been sewn into the interior 52 of the shirt at the bottom hem 54 in the embodiment shown. The pocket 50 has a transverse rectangular opening 56 to allow access to the mouth 58 of the opener 46. There is a top retaining flap 60 that is mounted above the access opening 48 of the pocket 50 that can fold over and retain the opener 46 with fasteners. Flap fastener 62 couples with fastener 64 when the flap 60 is in place. The opener 46 is kept in place by the flap 60 when the fasteners are joined and can be removed from the enclosure by separating the fastener members 62 and 64, lifting the flap 60 and removing the opener 46 from the interior of the pocket 50.

Figure 4:
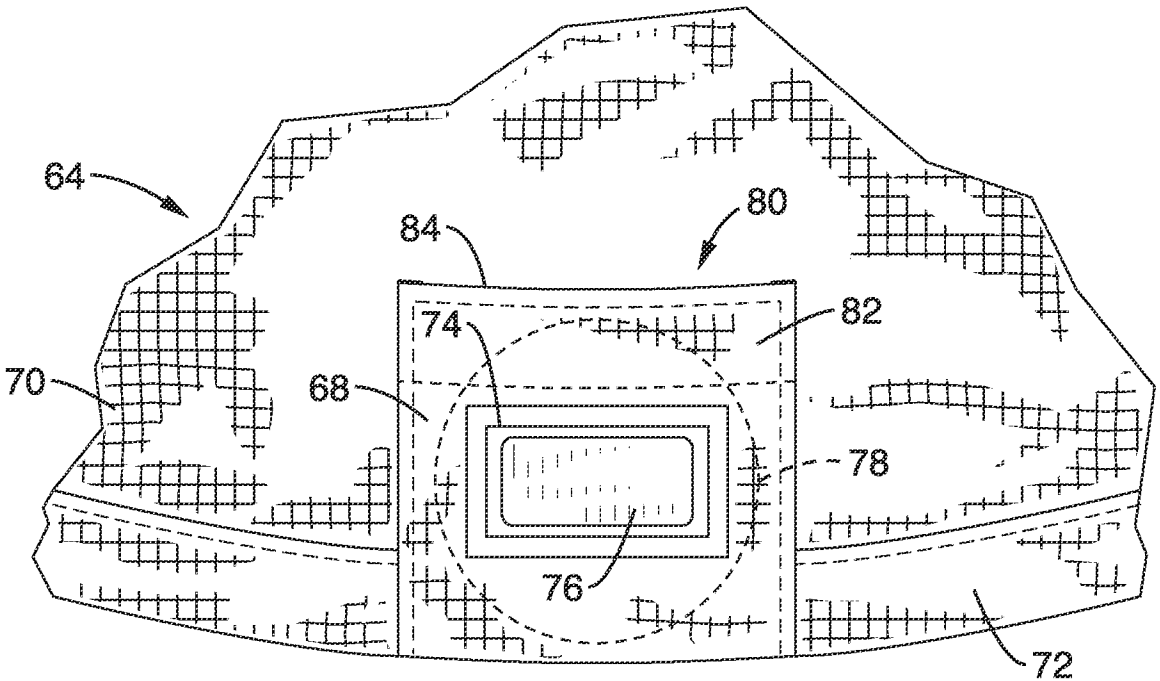
FIG. 4 is an alternative embodiment of the invention mounted to the lower hem of an article of clothing with an opener restraining top fold and the front opening of the pocket facing the interior.

A third alternative embodiment 64 of the invention is shown in FIG. 4. In this embodiment, there is a pocket 68 mounted to the interior surface 70 of the shirt at the bottom hem 72. The pocket 68 has an access opening 74 to allow access to the mouth 76 of the opener 78. The opener 78 is placed in pocket enclosure 80 of the pocket through a top access opening and under a lip 82 of the top edge 84 of the pocket 68. The interior lip 82 and the placed bottle opener 78 are shown in dashed lines. The lip is formed by horizontally folding the top pocket material over and sewing both of the ends. The bottle opener 78 can be removed from the pocket enclosure 68 interior by lifting the lip 82 material over the edge of the bottle opener 78 and extracting the opener 78 through the top access 74.

Although a lower shirt hem with an interior pocket is shown as an illustration, it will be understood that the invention can be adapted for other articles of clothing such as short pants and the pocket could be placed on the exterior of the clothing without departing from the invention.

Figure 6:
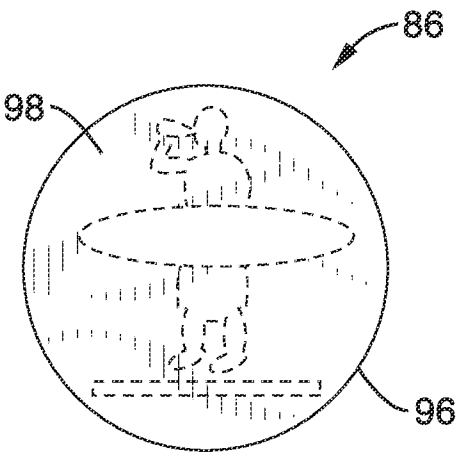
FIG. 6 is the back view of the opener embodiment of FIG. 5 with promotional indicia on the surface.
Figure 5:
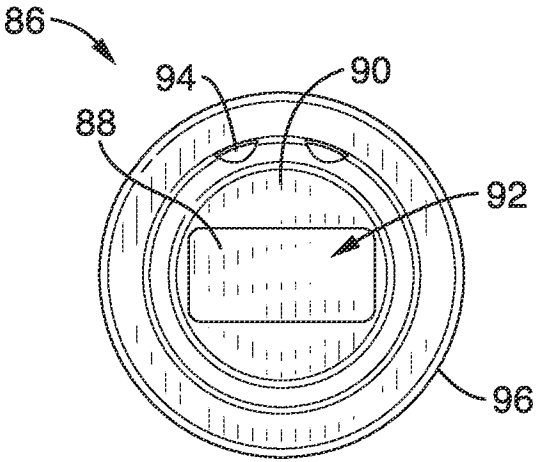
FIG. 5 is a front view of one embodiment of an opener with a circular shape.

Turning now to FIG. 5 and FIG. 6, one embodiment of a bottle opener is generally shown. A front view of one type of bottle opener 86 is shown in FIG. 5 and the back view of the bottle opener 86 is shown in FIG. 6. It can be seen that the opener 86 is generally planar with front side that includes the bottle opener and a substantially flat back surface.

Although an opener with a circular edge 96 is shown in FIG. 5 and FIG. 6, it will be understood that square or other shaped openers can be used. The bottom edge of a square shaped opener, for example, will nestle very well within the square interior of the pocket. The opening 88 of the bottle opener will be oriented and will not rotate within the pocket with a square shaped opener because the walls of the opener will fit snugly with the bottom and side walls of the pocket.

The front side of opener 86 has a mouth 88 that engages the edges of the bottle cap. In this embodiment, the mouth 88 opens to an interior chamber 92 formed from a raised top surface 90. The chamber 92 also has ports 94 to allow gasses to exit when a bottle with carbonated liquid is opened.

The mouth 88 of the opener 86 shown in FIG. 5 has a generally rectangular shape with the top and bottom horizontal edges engaging the crimped bottle cap at the top of the cap and at the crimped edge of the cap. Although a rectangular mouth 88 and chamber 92 opener configuration is shown, it will be understood that other cap removing designs may also be used such as a circular cap engaging ring with a tooth that forces the crimped edge. The rectangular mouth 88 configuration is preferred because it permits the opener 86 to have a low profile and smooth edges.

The back side surface of opener 86 is generally planer allowing advertising or other matter 98 to be placed on this surface in this embodiment. Promotional material 98 such as the logos and trademarks of a drink manufacturer can be applied to the back surface of the opener. Other advertising indicia can be applied such as organization identifiers. For example, school emblems, company logos, fraternity and sorority symbols, charitable organization names, event tag lines and coined phrases indicating the source of goods. The indicia may also include the name of professional sport teams, league logos, amateur team logos or musical group names. The advertising indicia 98 that can be applied to the back surface of the opener 86 is not limited by anything other than space.

In addition, the advertising indicia 98 of opener 86 may also include auxiliary devices (not shown) such as a sound producing device that plays an advertising jingle, school song, humorous phrase or sound when activated. The auxiliary device may also be an LED light with batteries and switch or may include a storage container.

Figure 7:
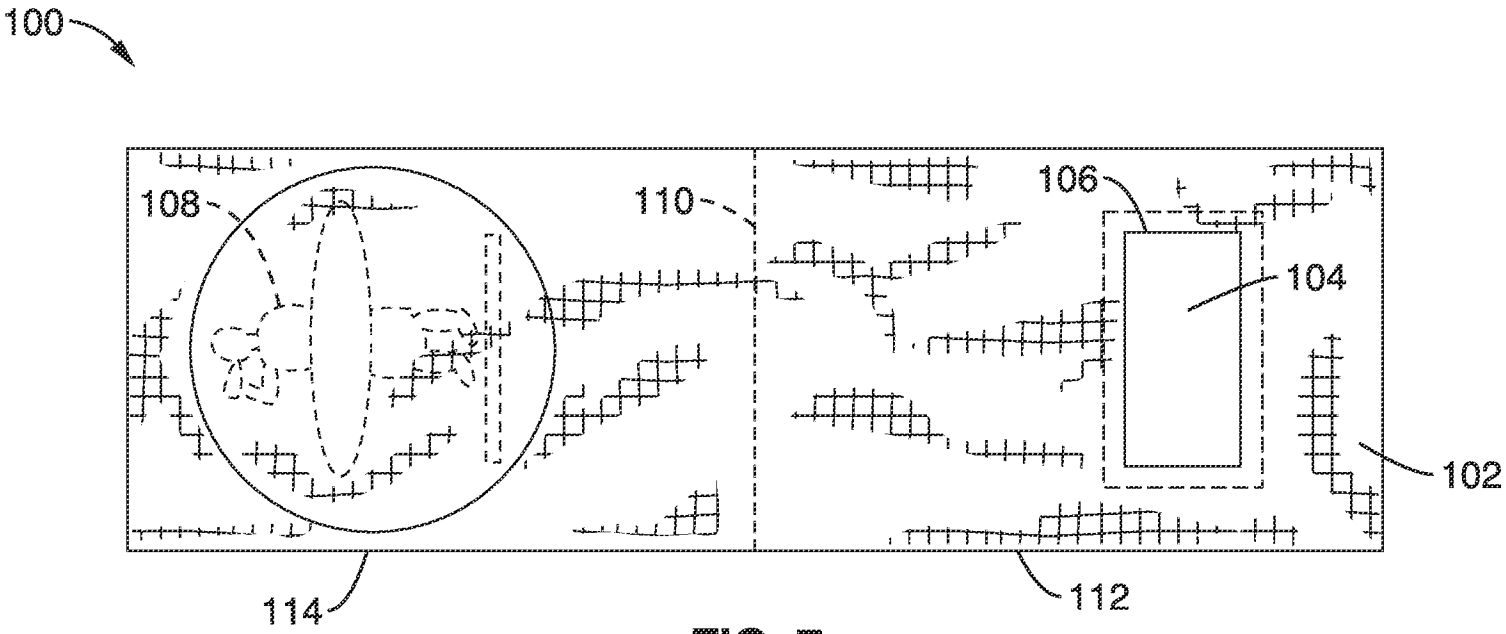
FIG. 7 is a top view of the pocket forming body including promotional indicia and side opening.

Turning now to FIG. 7, one embodiment of the material 100 that is used to form the interior pocket and to provide advertising space on the exterior of the article is shown. A linear strip of material 102 is provided that has a slotted opening 104 that can be optionally reinforced with stitched material 106 to avoid fraying. The reinforcing material 106 can also be a liquid absorbing material that can absorb any liquid ejected from the bottle during opening. The absorbing material helps avoid the creation of a wet spot on the article of clothing at the site after multiple bottle openings or overflow. In one embodiment, the whole interior pocket wall of the pocket enclosure has absorbing material attached.

At the other end of the strip 102, advertising 108 is printed on the strip. The advertising can be from any source such as sponsors or drink manufacturers or charities and the like and is a method for advertising on clothing. The advertising indicia 108 may be the same as the advertising indicia 98 applied to the opener 86 or it may be different. For example, the advertising 108 may be for the manufacturer of the clothing that includes the pocket of the invention identifying the source of the clothing.

Figure 8:
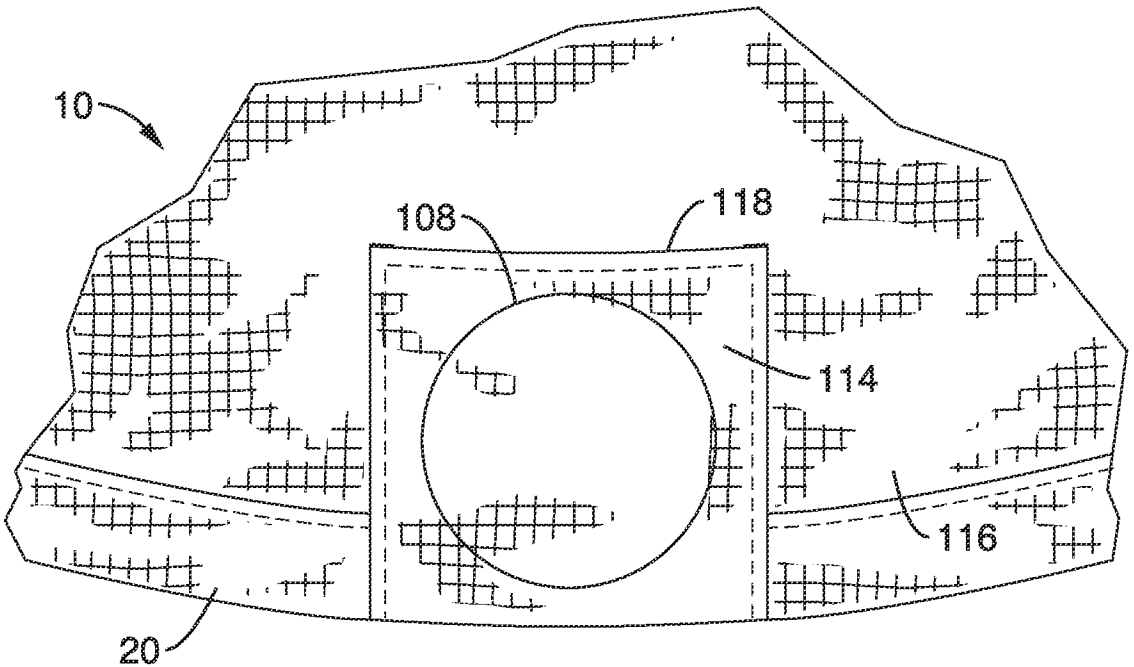
FIG. 8 is a back view of the invention on the exterior of the article showing the pocket body and advertising indicia.

Referring also to FIG. 8, the pocket enclosure is formed by folding the strip 102 approximately in half along the midline 110 so that there are two legs 112 and 114 that straddle the hem of the article of clothing so that leg 112 is on the interior of the clothing to form the pocket and the second leg 114 is on the outside of the clothing so that the advertising 108 is visible. The long side edges of the folded strip are sewn together or otherwise mounted to the clothing so that the pocket enclosure is formed with access opening at the top and interior and exterior walls. In addition to the vertical stitching of the side edges of exterior leg 114 through the material of the clothing and the interior leg 112, the top edge of leg 114 on the exterior 116 of the shirt alone is also preferably sewn with a horizontal seam 118 to the material of the shirt. Of course the corresponding top side of the interior first leg 112 may also be sewn, but it is normally left open so that the pocket formed from leg 112 is open with an opener access opening and the opener can be easily removed from the pocket enclosure.

The material of the second leg 114 of strip 102 not only provides a medium for advertising but it also provides additional material to support and reinforce the pocket. In one embodiment the end of leg 112 is folded over to form a lip before the edges are sewn to provide a means for retaining the bottle opener shown in FIG. 4.

While the pocket created on the on the interior surface of the clothing is preferred, the pocket could also be placed on the outside 116 of the article of clothing. Likewise, the article of clothing need not be hemmed.

It will be also seen that the strip of material 102 can be applied to any existing article of clothing as an add-on or sewn in at the factory as part of a new article of clothing.

Figure 9:
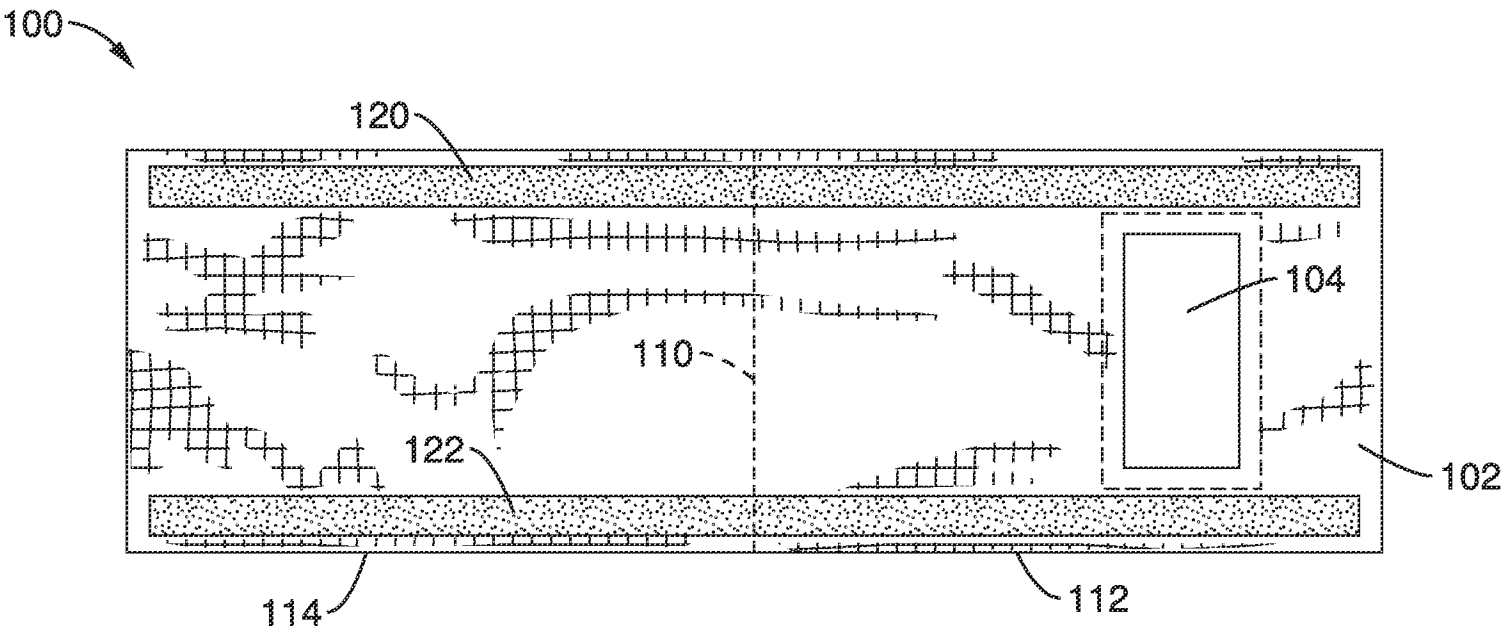
FIG. 9 is a bottom view of an alternative embodiment of the pocket forming body with fasteners that permit the pocket to be reversibly mounted to an article.

Although the first leg 112 and the second leg 114 are preferably folded over the material of the article along the line 110 and stitched as described, it will be understood that different methods of fastening the two legs 112, 114 of material 102 to the article can be used. The methods may be permanent such as glue or may be reversible such as with the use of snaps or hook and loop fasteners. For example, vertical strips of hook and loop fasteners 120 and 122 or rows of snaps can be mounted perpendicularly to the horizontal edge of the article on the exterior 116 surface and the interior surface 18 of the clothing. Corresponding strips or rows of snaps can be mounted near the edges of the surface of strip 102 on the opposite side of the strip that has the advertising indicia as seen in FIG. 9. Joining of the fasteners creates an interior pocket that can receive an opener on one side of the article and advertising on the other exterior side of the article. In this embodiment, the pocket is effectively transferrable from one article of clothing to another and can be removed prior to washing the clothing if desired.

Accordingly, the present invention provides a vehicle for advertising that is permanent and provides the functionality of a bottle opener that is easily accessible. The opener can also be removed from the clothing and have advertising on the bottom surface as illustrated in FIG. 6.

From the foregoing it can be seen that the invention can be embodied in various ways, including but not limited to the following:

1. An apparatus, comprising an article of clothing; a pocket formed on a surface of the article of clothing, the pocket having an interior and an exterior, an access opening to the pocket interior and a transverse slot in a sidewall of the pocket; and a bottle opener disposed within the pocket, the opener having a mouth; wherein the mouth of the opener is oriented with said transverse slot of the pocket so that the mouth of the opener is open to the exterior of the pocket when the bottle opener is disposed within the interior of the pocket.

2. The apparatus of embodiment 1, further comprising means for retaining said bottle opener within said pocket.

3. The apparatus of embodiment 2, wherein the means for retaining the opener comprises a bottle opener retaining flap mounted to a surface of the article of clothing and a fastener; wherein the flap encloses the access of the pocket when the flap engages the fastener.

4. The apparatus of embodiment 2, wherein the means for retaining the opener comprises a bottle opener retaining fold within the interior of the pocket; wherein the bottle opener engages the fold within the interior of the pocket restricting movement of the opener within the pocket.

5. The apparatus of embodiment 1, the bottle opener further comprising advertising indicia applied to a surface of the bottle opener.

6. The apparatus of embodiment 5, wherein the advertising indicia is selected from the group of indicia consisting essentially of a beverage manufacturer logo, a company name, a school logo, a sports team logo, fraternity and sorority symbols, musical group names and charitable organization names.

7. The apparatus of embodiment 5, wherein the advertising indicia is selected from the group of indicia consisting essentially of an electronic sound generator and a light source.

8. The apparatus of embodiment 1, wherein the pocket comprises a planar rectangular sheet with a front half and a back half, top and bottom surfaces and a transverse slot; and wherein the bottom surface of the front half of the sheet is mounted to an exterior surface of the article and the bottom surface of the back half of the sheet is mounted to an interior surface of the article.

9. The apparatus of embodiment 8, the planar rectangular sheet further comprising advertising indicia applied to the top surface of the sheet.

10. The apparatus of embodiment 8, the planar rectangular sheet further comprising a plurality of fasteners mounted to the article and the bottom surface of the sheet; wherein the pocket can be reversibly mounted to the article.

11. An apparatus, comprising an article of clothing having an interior and exterior surface and one or more linear edges; a pocket on the interior surface of said article of clothing, said pocket having an access opening, enclosure and a transverse slot; and a bottle opener disposed within said pocket, said opener having a mouth; wherein said mouth of said opener is oriented with said transverse slot of said pocket so that the mouth of the opener can engage a bottle cap through the slot when the bottle opener is disposed within the pocket enclosure.

12. The apparatus of embodiment 11, the pocket further comprising a plurality of liquid absorbent strips mounted to at least one edge of the transverse slot.

13. The apparatus of embodiment 11, wherein the pocket comprises a planar rectangular sheet with a front half and a back half, top and bottom surfaces and a transverse slot; and wherein the bottom surface of the front half of the sheet is mounted to an exterior surface of the article and the bottom surface of the back half of the sheet is mounted to an interior surface of the article.

14. The apparatus of embodiment 13, the planar rectangular sheet further comprising a plurality of fasteners mounted to the interior and exterior surfaces of the article and the bottom surface of the sheet; wherein the pocket can be reversibly mounted to the article of clothing.

15. The apparatus of embodiment 13, the planar rectangular sheet further comprising advertising indicia applied to the top surface of the sheet.

16. The apparatus of embodiment 11, further comprising a bottle opener retaining flap mounted to a surface of the article of clothing and a fastener; wherein the flap encloses the access opening of the pocket when the flap engages the fastener.

17. The apparatus of embodiment 11, the bottle opener further comprising advertising indicia applied to a surface of the bottle opener.

18. The apparatus of embodiment 17, wherein the advertising indicia selected from the group of indicia consisting essentially of an electronic sound generator and a light source.

19. A method for advertising, comprising: providing an article of clothing with hemmed edges and an interior and exterior surface; providing an elongate strip of material, the material having an opening and advertising indicia printed on the material; folding the strip of material lengthwise straddling a hem of the article of clothing with the opening of the strip on an interior surface of the article of clothing; mounting the folded strip to the article of clothing forming a pocket on the interior surface of the clothing; and placing a bottle opener within the pocket.

20. The method of embodiment 19, further comprising providing advertising on the bottle opener.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus, comprising:

an article of clothing;

a pocket formed on a surface of the article of clothing, the pocket having an interior and an exterior, an access opening and a transverse slot; and a bottle opener disposed within the pocket, the opener having a mouth;

wherein the mouth of the opener is oriented with said transverse slot of the pocket so that the mouth of the opener is open to the exterior of the pocket when the bottle opener is disposed within the interior of the pocket;

wherein said pocket comprises a planar rectangular sheet with top and bottom surfaces, a front half, and a back half, said transverse slot in said back half of said sheet; and wherein the bottom surface of the front half of the sheet is mounted to an exterior surface of the article and the bottom surface of the back half of the sheet is mounted to an interior surface of the article of clothing.

2. An apparatus as recited in claim 1, further comprising means for retaining said bottle opener within said pocket.

3. An apparatus as recited in claim 2:

wherein said means for retaining said opener comprises a bottle opener retaining flap mounted to a surface of said article of clothing and a fastener; and wherein said flap encloses said access opening of said pocket when the flap engages the fastener.

4. An apparatus as recited in claim 2:

wherein said means for retaining said opener comprises a bottle opener retaining lip within the interior of the pocket; and wherein said bottle opener engages said lip within the interior of the pocket restricting movement of the opener within the pocket.

5. An apparatus as recited in claim 1, said bottle opener further comprising:

advertising indicia applied to a surface of the bottle opener.

6. An apparatus as recited in claim 5, wherein said advertising indicia is indicia selected from the group of indicia consisting essentially of: a beverage manufacturer logo, a company name, a school logo, a sports team logo, fraternity and sorority symbols, musical group names and charitable organization names.

7. An apparatus as recited in claim 5, wherein said advertising indicia is indicia selected from the group of indicia consisting essentially of an electronic sound generator and a light source.

8. An apparatus as recited in claim 1, said planar rectangular sheet further comprising advertising indicia applied to the top surface of the sheet.

9. An apparatus as recited in claim 1, said planar rectangular sheet further comprising:

a plurality of fasteners mounted to the article and the bottom surface of the sheet;

wherein the pocket can be reversibly mounted to said article.

10. An apparatus, comprising:

an article of clothing having an interior and exterior surface and one or more linear edges;

a pocket on the interior surface of said article of clothing, said pocket having an access opening, enclosure and a transverse slot; and a bottle opener disposed within said pocket, said opener having a mouth;

wherein said mouth of said opener is oriented with said transverse slot of said pocket so that the mouth of the opener can engage a bottle cap through the slot when the bottle opener is disposed within the pocket enclosure;

wherein said pocket comprises a planar rectangular sheet with top and bottom surfaces, a front half, and a back half, said transverse slot in said back half of said sheet; and wherein the bottom surface of the front half of the sheet is mounted to said exterior surface of the article and the bottom surface of the back half of the sheet is mounted to said interior surface of the article.

11. An apparatus as recited in claim 10, said pocket further comprising a plurality of liquid absorbent strips mounted to at least one edge of the transverse slot.

12. An apparatus as recited in claim 10, said planar rectangular sheet further comprising:

a plurality of fasteners mounted to the interior and exterior surfaces of the article and the bottom surface of the sheet;

wherein the pocket can be reversibly mounted to the article of clothing.

13. An apparatus as recited in claim 10, said planar rectangular sheet further comprising advertising indicia applied to the top surface of the sheet.

14. An apparatus as recited in claim 10, further comprising:

a bottle opener retaining flap mounted to a surface of said article of clothing and a fastener;

wherein said flap encloses said access opening of said pocket when the flap engages the fastener.

15. An apparatus as recited in claim 10, said bottle opener further comprising advertising indicia applied to a surface of the bottle opener.

16. An apparatus as recited in claim 15, wherein said advertising indicia is indicia selected from the group of indicia consisting essentially of an electronic sound generator and a light source.

* * * * *